United States Patent [19]

Covault

[11] 4,102,152

[45] Jul. 25, 1978

[54] HEAT EXCHANGE DEVICE FOR AIR CONDITIONERS

[76] Inventor: Darrell W. Covault, 30 Green Ct., Bridgeton, Mo. 63044

[21] Appl. No.: 718,420

[22] Filed: Aug. 27, 1976

[51] Int. Cl.[2] ..... F25B 39/04; F28F 1/32

[52] U.S. Cl. ..... 62/428; 165/170; 165/171

[58] Field of Search ..... 62/428, 507, 515; 165/171, 179, 168, 185, 170; 29/157.3

[56] References Cited

U.S. PATENT DOCUMENTS

| | | | |
|---|---|---|---|
| 520,930 | 6/1894 | Levey et al. | 165/171 |
| 1,977,731 | 10/1934 | Masury | 165/185 |
| 2,131,929 | 10/1938 | Amme | 165/185 |
| 2,294,137 | 8/1942 | Spofford | 165/179 |
| 2,401,235 | 5/1946 | Farr et al. | 165/185 |
| 2,428,876 | 10/1947 | Hawkins | 165/185 |
| 2,688,794 | 9/1954 | Malutich | 165/171 |
| 2,881,600 | 4/1959 | Elfving | 62/507 |
| 2,912,230 | 11/1959 | Rataiczak | 165/171 |
| 3,059,447 | 10/1962 | Brugler | 62/507 |
| 3,269,459 | 8/1966 | Popovitch | 165/170 |
| 3,285,514 | 11/1966 | Smith | 165/171 |
| 3,431,973 | 3/1969 | Kritzer | 165/168 |
| 3,877,247 | 4/1975 | LeCouturier | 62/507 |

FOREIGN PATENT DOCUMENTS

| | | | |
|---|---|---|---|
| 907,912 | 5/1959 | United Kingdom | 165/168 |

*Primary Examiner*—William E. Wayner
*Assistant Examiner*—B. Charvat
*Attorney, Agent, or Firm*—Clarence A. O'Brien; Harvey B. Jacobson

[57] ABSTRACT

A heat exchange device for air conditioners and the like comprising a primary body member of sheet plate material having tubular flow conduit fastened thereto for receiving and containing the flow of fluid such as the liquid/gas used with air conditioners and the like. Projecting pins securely attached to the plate member or members in single or double rows alternately with the tubing material provide the heat exchange improvement. Several different embodiments of the tubing and rows of projecting pins are provided for various type of applications. Another embodiment replaces the tubular flow conduit with a second plate member with the refrigerant flow being between the two plate members.

2 Claims, 8 Drawing Figures

10
12
13
13'
14
14'
15
15'
16
18
20
21
22
23
24
24'
25
26
27
28
29
30
30'
31
32
32'
34
34'
35'
36
36'
62
64
A
B
B'
C
C'
8

34"
36"
35'
34'
32'
40
35'

36
32
42
41
37
44

35'
36'
34'
33
32'
4
4
33

57
50
56
49
36B
53
51
36A
52
36
57
48
56
36
34
35
30
32
35
34
33
34

HEAT EXCHANGE DEVICE FOR AIR CONDITIONERS

BACKGROUND OF THE INVENTION

1. Field of the Invention

This invention relates generally to heat exchange devices for use with air conditioning devices and the like and especially for heat exchange structure which will greatly increase the overall efficiency of such process.

2. Description of the Prior Art

A common problem with known type heat exchange devices used with air conditioners and especially of the automotive type, is that an efficient exchange between the gas/liquid flowing in the air conditioning system with the ambient air circulating over the heat exchange surfaces leaves quite a bit to be desired. The overall cooling in the automobile with which such an air conditioner is used depends greatly upon the efficiency of the condensing coil as well as the evaporating coil. Any improvement in either or both of these heat exchange coils will greatly increase the overall efficiency of the system.

Another problem with known type heat exchange systems as used with automotive air conditioners and the like is that the construction expense and material expense are quite great. Anything that can be done to decrease the cost of the cooling and condensing units will be of great benefit.

SUMMARY OF THE INVENTION

An object of the present invention is to provide a heat exchange structure for use with automotive-type air conditioner systems and the like which will increase the overall efficiency of such system.

Another object of the present invention is to provide a heat exchange system which will be more readily manufactured with less expense than known type devices.

A further object of this invention is to provide a heat exchange structure which may be used for either the condensing coil unit of an air conditioning system, or the cooling coil unit of said system, or both if desired.

A still further object of this invention is to provide a heat exchange structure which includes a basic plate member for mounting upon appropriate associated structure, tubular flow structure firmly attached to said mounting plate in good heat flow relationship thereto and projecting pin members arranged in various embodiments, and alternately in single or double rows with the flow tubing structure in order to greatly increase the overall efficiency of the device.

A further object is to provide a heat exchange structure which is more easily manufactured at less cost and more quickly than conventional type exchange structures.

The heat exchange structure and the various embodiments thereof of this invention consists basically of a primary plate member or members supporting securely attached and in good heat flow relationship thereto flow structure for conducting the gas/liquid medium as used in conventional air conditioners and especially as used in automotive type air conditioners. Projecting from the support plate member are pins securely attached thereto for greatly increasing the surface area over which the surrounding air flows, either by convection or preferably by forced blower means, in order to greatly increase the overall efficiency of the heat exchange process. The flow tubing is arranged to alternately reverse the flow path of the medium being conducted thereby and also alternately spaced with the projecting pins arranged in single or double rows therebetween.

The pins may be supported through punched or drilled apertures in the plate member and then secured by brazing, soldering, or other deposition of metal material to securely attach and hold the projecting pins within and on the plate member.

Another embodiment utilizes the primary plate together with a secondary plate to form a flow path therebetween for the gas/liquid medium. In this embodiment the flow tubes are eliminated and the plate members themselves form the conducting flow channel for such refrigerant medium.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figures 1, 7, 8:
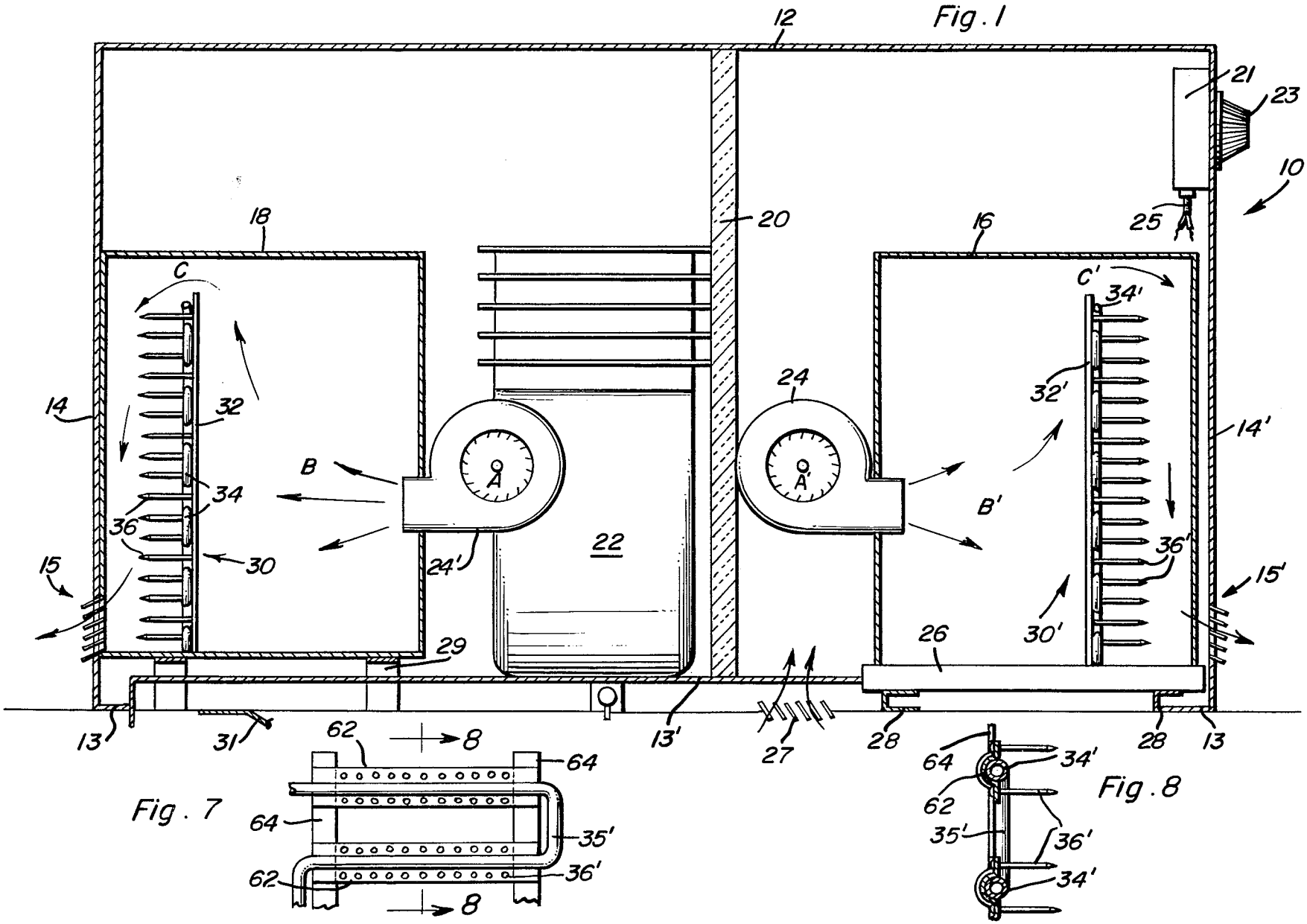
FIG. 1 is a side elevational view, partly in cross section, of an automotive type air conditioner system using the heat exchange device of this invention.
FIG. 7 is another embodiment as arranged to provide for an automobile type radiator cooling coil.
FIG. 8 is a side cross-sectional view taken generally along line 8—8 of FIG. 7.

Referring to FIG. 1 of the drawings, reference numeral 10 indicates in general, the arrangement of two heat exchange devices as used with a automotive type air conditioning system. The top of the auto air conditioner is indicated by reference numeral 12 with two end portions 14, 14' and a bottom structure 13. Air flow grilles 15, 15' are provided in each of the ends with a cooling air container 16 being provided in one-half of the overall housing and a condenser unit 18 being provided in the other. A partition 20 of insulating material separates the two portions of the air conditioner system. A conventional type auto or house refrigeration compressor 22 is provided on or within the condenser portion of the overall air conditioner. This structure is basically conventional and will not be described in greater detail.

Blower units 24 and 24' provide a forced air flow over the respective cooling and condenser units. A water and condensate collecting pan 26 is provided mounted upon appropriate supports 28 from the bottom structure 13. This collection pan may be connected to discharge tubing for feeding any collected water out-side of the overall housing. The support structure 29 also is provided and associated with the housing for the condenser structure 18. An air inlet grille 27 is also provided for the cooling unit while an air intake flap 31, shown in part and which may be adjustable, is provided for the condenser unit. Mounted upon the cooling end of the air conditioner is an adjustable thermostat 21, having a knob 23 and associated wiring 25 for connection to the electrical wiring of the air conditioner.

As is conventional with air conditioner units the compressor 22 compresses the refrigerant within the system into normally liquid form which passes through the heat exchange unit 30 within the condenser portion 18 of the system. At this point, forced air from the blower 24' which enters through the flap 31 at the bottom of the air conditioner housing upwardly into the inlet A of the blower for pressure exhaust at B and for flow over the heat exchanger plate 32 to the top thereof at gap C, and then downwardly and outwardly over projecting pins 36 for exhaustion through the grille 15. The liquid refrigerant is the passed through an expansion valve or other conventional type cooling means into the cooling unit 30' at the right of the view of FIG. 1.

Input air is drawn in through the grille 27 and into the blower 24 at input A' for forced discharge at B' and upward flow over the backside of plate 32' through the gap C' and then downwardly and outwardly past the projections 36' for discharge out grille 15'. The expanding refrigerant in the heat exchanger 30' within cooling portion 16 greatly cools the air being forced thereover to provide the appropriate cooling at the discharge 15' of the air conditioner.

Figures 2, 3, 4, 5, 6:
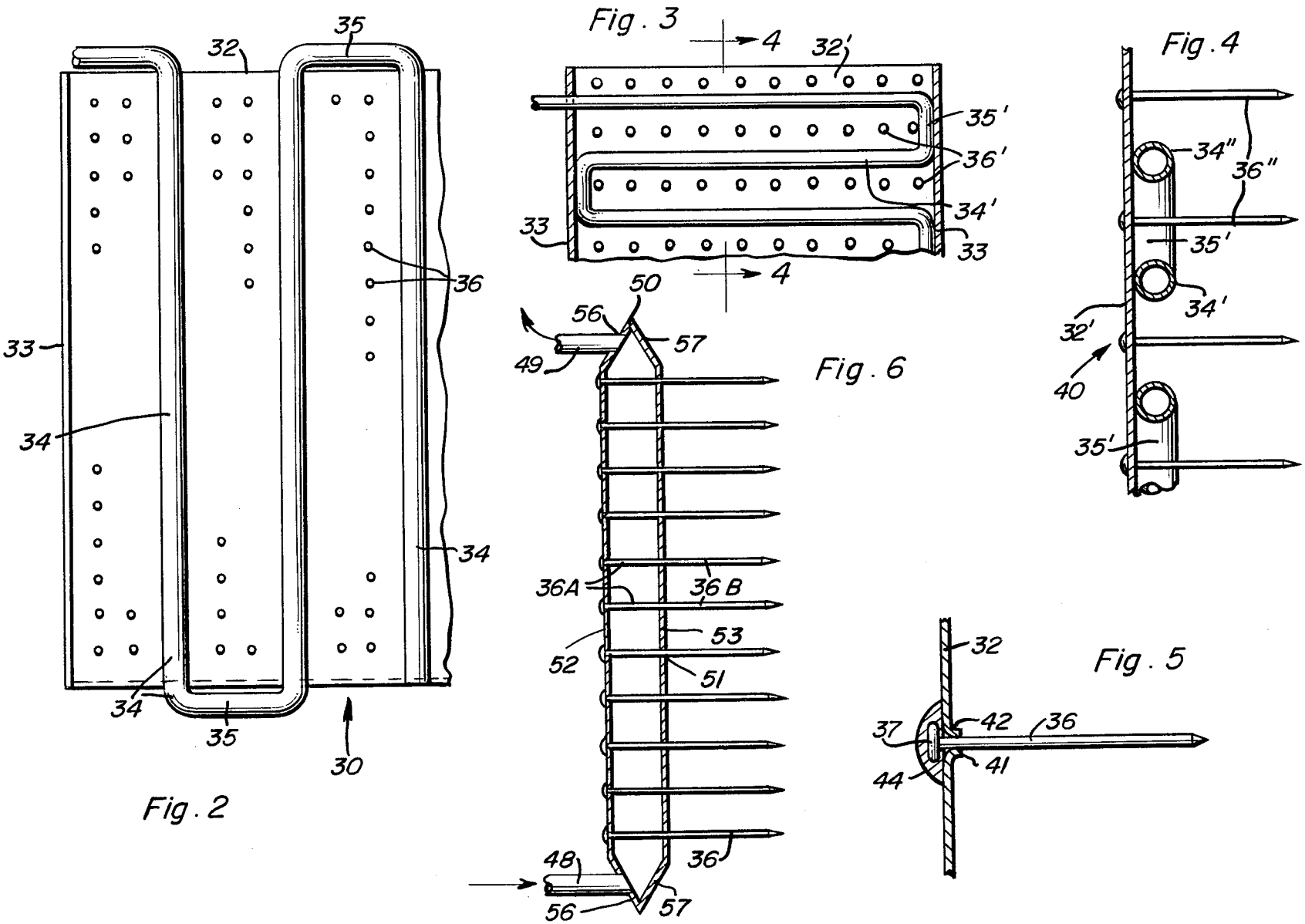
FIG. 2 is a view, in part, of a heat exchange device as used in FIG. 1.
FIG. 3 is an end view, in part, of another type of heat exchange device as used in FIG. 1.
FIG. 4 is a side cross-sectional view taken generally along line 4—4 of FIG. 3.
FIG. 5 is an enlarged detail of one of the heat exchange pins as mounted and secured in one of the plate members.
FIG. 6 is a modified embodiment of the plate members for providing an integral gas/liquid flow channel.

While the refrigerant flow tubing 34, 34' in FIG. 1 is shown as transversing back and forth in a horizontal direction, the units will work equally as well with the tubing transversing vertically. This manner of construction is best seen in the embodiment of FIG. 2. In this embodiment, the flow tubing 34 is appropriately connected at respective ends thereof by the continuing portions of the tubing 35 so that the tubing traverses the plate 32 as seen. The tubing is securely fastened to the plate member 32 by means of soldering, brazing, or other type of metal welding procedures. Appropriate outer flanges 33 may be provided at the edges of the plate member 32 for strength and rigidity.

In order to increase the overall efficiency of the heat exchange between the refrigerant flowing through the tubing and the air passing over the combined tubing and plate, projecting pins 36 are provided. These projecting pins as shown in FIG. 2 may be arranged in two rows alternating with the refrigerant flow tubing. This arrangement has been discovered to greatly increase the heat transfer relationship of the structure.

In FIG. 3, the flow tubing is arranged alternately and transversely in a horizontal direction with flow tubing 31' connected at the respective ends thereof with continuous flow tubing 35'. In this embodiment single rows of pins 36' alternate with the flow tubing. This embodiment also may be seen in cross section in FIG. 4 wherein the length of the pins 36' with respect to the diameter and size of the refrigerant flow tubing 34' may be compared. As indicated generally be reference numeral 40 in FIG. 4, the pins are secured to the plate member 32' as best seen in the enlarged view of FIG. 5. Here the plate 32 is shown with a single perforation or aperture provided therein. This aperture 41 may be appropriately punched, drilled, or otherwise provided in the plate. Normally, if a punching process is used a flanged edge 42 will surround the hole in the direction opposite from which the punch was made. A punching operation is a relatively quick and inexpensive method of providing the needed number of holes in the plates 32. Pins 36 having heads 37 thereon are then placed through the apertures 41 and then metal solder or brazing material 44 completely covers the head and surrounds the aperture to secure the pins within the holes. It should be noted that the diameter or outer circumference of pins 36 preferably are just slightly larger than the apertures 41 so that said pins must be force fitted into the respective holes. This in addition to the weld or solder material 44 functions to positively hold said pins in good heat exchange relationship with the plate 32.

While the embodiment of FIG. 2 shows alternately spaced flow tube paths alternately with double rows of heat exchange pins, and the embodiments of FIGS. 3 and 4 show single rows of spaced heat exchange pins between the traversing flow tubing, the embodiment of FIG. 6 eliminates the traversing alternting tubes 34, 34' and replaces them with a second plate structure for containing the refrigerant flow. In this arrangement, the primary plate 52 supports and contains the spaced projecting pins 36 as described for the previous embodiments. However, in addition to this plate another plate 53 having apertures 51 therein is attached at the edges 50 to the first plate 52. The spacing between the plates 52 and 53 provides the refrigerant flow channel in place of the tubing 34, 34'. Inwardly flange portions 56 on the plate 52 meet and complement inwardly flange portions 57 on the plate 53, and are appropriately welded or otherwise joined together along line 50 at the junction point therebetween. An input tube 48 and an exhaust tube 49 are also provided in apertures in one of flanges 56, or 57 of the respective plates. Obviously, all the connections of the tubing projecting pins, apertures, flared junction joints, etc. are securely brazed or welded to form fluid and air tight junctions. In this embodiment, the refrigerant flow will directly contact the portion **36*a* of the heat transfer pins contained within the plates 52 and 53 while the outer portions of the pins 36*b*** will conduct the heat to the air flowing thereover. Thus, one can readily visualize how the overall efficiency of this heat exchange device will be greatly increased by this method of arrangement and construction.

FIGS. 7 and 8 show another embodiment of the heat exchange device as used for the condenser unit normally mounted adjacent an automotive radiator in an automobile type air conditioning structure. This embodiment is quite similar to that of FIGS. 3 and 4, but has a plurality of plate members 62 instead of a single plate member 32 as in the embodiment of FIGS. 3 and 4. These plurality of plate members 62 are mounted upon end support structure 64 which in turn may be appropriately secured adjacent the radiator of an automobile. Pins 36' are provided on either side of the flow tubing 34' for the refrigerant. Again, all the component parts are secured together by soldering, brazing, welding or the like. From the above description, one can readily visualize how the improved heat exchanger structure as disclosed herein will greatly increase the efficiency of same and also increase the overall efficiency of the entire air conditioner system.

The foregoing is considered as illustrative only of the principles of the invention. Further, since numerous modifications and changes will readily occur to those skilled in the art, it is not desired to limit the invention to the exact construction and operating shown and described, and accordingly all suitable modifications and equivalents may be resorted to, falling within the scope of the invention.

What is claimed as new is as follows:

1. In an air conditioning system including a compressor, a housing structure for said compressor, a condenser unit within the housing structure and having an air flow exit vent formed therein, a blower directing air from externally of the housing structure into the condenser unit, a cooling unit within the housing structure and having an air flow exit vent formed therein, an expansion apparatus associated with the cooling unit, and a blower directing air from externally of the housing structure into the cooling unit, the improvement comprising a first plate-like heat exchange and support member mounted in the condenser unit, a second plate-like heat exchange and support member mounted in the cooling unit, each of the members being disposed between the respective blowers in the units and the air flow exit vents formed therein such that the flow of air is directed into contact with the members, tube means for containing a refrigerant fluid secured to surface portions of each heat exchange and support member, and a plurality of pins projecting from a surface of each heat exchange and support member and being secured thereto, the pins extending from the surface of the heat exchange and support members into unobstructed contact with the flow of air.

2. The apparatus of claim 1 wherein the heat exchange and support members are continguous to wall portions of the condenser unit and cooling unit except along the upper edge surfaces of the members and upper portions of the walls of the condenser unit and cooling unit, the openings forming a portion of air flow paths between the respective blowers and the respective air flow exit vents, and wherein the air flow exit vents in the condenser unit and cooling unit are formed in lower wall portions thereof, the pins projecting from the surface of each heat exchange and support member which is opposite to the respective blower and which is facing the respective air flow exit vent, the pins thereby lying directly in the flow path of the air as the air moves between each blower and each air flow exit vent.

* * * * *